US008241007B2

(12) United States Patent
Tanaka

(10) Patent No.: US 8,241,007 B2
(45) Date of Patent: Aug. 14, 2012

(54) OIL-INJECTION SCREW COMPRESSOR

(75) Inventor: Hideharu Tanaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 294 days.

(21) Appl. No.: 11/544,657

(22) Filed: Oct. 10, 2006

(65) Prior Publication Data

US 2007/0140866 A1 Jun. 21, 2007

(30) Foreign Application Priority Data

Dec. 19, 2005 (JP) ..... 2005-364423

(51) Int. Cl.
*F04B 49/035* (2006.01)
*F01C 1/16* (2006.01)
*F01C 1/24* (2006.01)

(52) U.S. Cl. ..... 417/28; 418/201.2

(58) Field of Classification Search ..... 417/26, 417/28, 310, 313; 418/201.2, 201.1, 270, 418/2

See application file for complete search history.

(56) References Cited

U.S. PATENT DOCUMENTS 3,860,363 A * 1/1975 Silvern et al. ..... 417/12
4,968,218 A * 11/1990 Koivula et al. ..... 416/19
5,897,299 A * 4/1999 Fukunaga ..... 417/316
6,461,112 B1 * 10/2002 Ohta et al. ..... 417/26
6,474,950 B1 * 11/2002 Waldo ..... 417/12
6,739,841 B2 * 5/2004 Nishimura et al. ..... 417/44.2
7,118,348 B2 * 10/2006 Dean et al. ..... 417/12
2002/0021969 A1 * 2/2002 Totsuka ..... 417/26
2004/0265132 A1 * 12/2004 Iimura et al. ..... 417/1
2005/0089432 A1 * 4/2005 Truyens et al. ..... 418/83

FOREIGN PATENT DOCUMENTS

JP 06-193579 7/1994
JP 7-4372 1/1995
JP 09-287580 11/1997
JP 2002-138977 5/2002

* cited by examiner

*Primary Examiner* — Devon C Kramer
*Assistant Examiner* — Bryan Lettman
(74) *Attorney, Agent, or Firm* — Antonelli, Terry, Stout & Kraus, LLP.

(57) ABSTRACT

An oil-injection screw compressor includes a blow-off valve disposed on the discharge side of the compressor body and capable of releasing a quantity of air beyond the discharge capacity of the compressor body when operating of the motor at the minimum number of revolutions; a suction non-return valve which, disposed on the suction side of the compressor body, is closed when it is at a stop; and a pressure sensor for detecting the discharge side pressure of the compressor body; and, a controller which, at the time of operation of the motor at the minimum number of revolutions, opens the blow-off valve when the discharge side pressure P detected by the pressure sensor has risen to a prescribed upper limit Pu and closes the blow-off valve when it has fallen to a prescribed control pressure Po.

14 Claims, 2 Drawing Sheets

OIL-INJECTION SCREW COMPRESSOR

INCORPORATION BY REFERENCE

The present application claims priority from Japanese application JP 2005-364423 filed on Dec. 19, 2005, the content of which is hereby incorporated by reference into this application.

FIELD OF THE INVENTION

The present invention relates to an oil-injection screw compressor in which oil is mixed into compressed gas.

DESCRIPTION OF RELATED ART

In recent years, to vary the discharge capacity of a screw compressor according to the consumed quantity of compressed gas with a view to energy saving, methods of variably controlling the revolutions of the motor to drive the compressor body have come to be known. Although theoretically the torque required for driving a compressor body is substantially constant irrespective of the number of revolutions if the discharge pressure is constant, it actually rises when the revolutions slow down on account of an increase in leaks within the compressor or some other reason. The motor also drops in output torque, cooling air flow volume and so forth in a low revolution range. Therefore, the minimum number of motor revolutions is usually regulated to about 10 to 30% of the maximum revolutions.

To adapt to a consumed quantity smaller than the discharge capacity of the compressor body when the motor is operating at its minimum number of revolutions, there has been a proposal, for instance, for an oil-injection screw compressor equipped with a suction throttle valve which is arranged on the suction side of the compressor body and adjusts the quantity of flow and an electromagnetic valve which can supply part of the compressed gas discharged from the compressor body to the driving section of the suction throttle valve and can discharge the remainder upstream from the suction throttle valve via blow-off piping (see JP-A-9-287580 for instance). According to this prior art, when the discharge side pressure of the compressor body has reached a prescribed upper limit when the motor is operating at its minimum number of revolutions, the compressor is run under no load by opening the electromagnetic valve to close the suction throttle valve and reducing the discharge side pressure of the compressor body. When the discharge side pressure of the compressor body has reached a prescribed lower limit during the no-load running, the compressor body is run under load by closing the electromagnetic valve and opening the suction throttle valve. In this way, the compressor body is run loaded and unloaded alternately. Further, though not expressly stated, when the compressor body is at a stop, the back flow of oil-containing compressed gas is prevented by closing the suction throttle valve.

However, this prior art leaves room for improvement in the following respect.

The suction throttle valve is provided with, for instance, a valve plate, a piston for driving the valve plate in the opening or closing direction, and a sealing member (a cap seal or O ring for instance) provided on this piston. For this reason, frequent opening and closing of the valve plate according to the switch-over between no-load running and loaded running of the compressor body invites wear of the sealing member, which therefore should be replaced periodically. Thus, the combination of a structure for no-load running of the compressor body and one for prevention of back flow when the compressor body is at a stop makes the parts less durable and invites a higher cost.

BRIEF SUMMARY OF THE INVENTION

An object of the present invention is to provide an oil-injection screw compressor capable of preventing back flow during its no-load running and stoppage while contributing to a cost reduction.

(1) In order to achieve the object stated above, according to the invention, an oil-injection screw compressor in which oil is mixed into the fluid to be compressed comprises a compressor body, a motor for driving the compressor body and an inverter for variably controlling the number of revolutions of the motor; a blow-off valve disposed on the discharge side of the compressor body and capable of releasing a quantity of air beyond the discharge capacity of the compressor body when operating the motor at the minimum number of revolutions; a suction non-return valve which, disposed on the suction side of the compressor body, is opened when the compressor body is operating and closing when it is at a stop; and a pressure detecting device for detecting the discharge side pressure of the compressor body, and a blow-off valve control device which, at the time of the motor operation at the minimum number of revolutions, opens the blow-off valve when the discharge side pressure of the compressor body detected by the pressure detecting device has risen to a prescribed upper limit and closes the blow-off valve when it has fallen to a prescribed control pressure.

According to the invention, the number of revolutions of the motor is variably controlled via the inverter according to the discharge side pressure of the compressor body detected by the pressure detecting device for instance, and the discharge capacity of the compressor body is thereby controlled. During the running of the motor at its minimum number of revolutions, when the discharge side pressure of the compressor body has risen to a prescribed upper limit, the blow-off valve is opened to run the compressor body under no load and, when the discharge side pressure of the compressor body has fallen to a prescribed control pressure, the blow-off valve is closed to run the compressor body under load. Also, when the compressor body is at a stop, the suction non-return valve is closed to enable the compressed fluid into which oil is mixed to be prevented from flowing back. As this suction non-return valve can be so simply structured as to be closed by the load of a spring for instance, the useful lives of components can be made longer and the cost lower than suction throttle valves. Therefore, according to the invention, back flow during the no-load running and the stoppage of the compressor body can be prevented while contributing to a cost reduction.

(2) In (1) above, there may be preferably provided a first stop control device which computes the pressure rise time taken by the discharge side pressure detected by the pressure detecting device to rise from the prescribed control pressure to the prescribed upper limit and the pressure fall time taken from the prescribed upper limit to the prescribed control pressure during the operation of the motor at the minimum number of revolutions, and stops the compressor body when the ratio between these pressure rise time and pressure fall time has reached a prescribed set ratio.

(3) In (1) above, there may be preferably provided a second stop control device which computes the pressure rise time taken by the discharge side pressure detected by the pressure detecting device to rise from the prescribed control pressure to the prescribed upper limit or the pressure fall time taken from the prescribed upper limit to the prescribed control pressure during the operation of the motor at the minimum number of revolutions, and stops the compressor body when this pressure rise time or pressure fall time has reached a prescribed set time length.

(4) In (2) or (3) above, there may be preferably provided a restart control device which, while the compressor body is at a stop, restarts the compressor body when the discharge side pressure detected by the pressure detecting device has reached a prescribed restart pressure.

(5) In (1) above, preferably the blow-off valve may be an electromagnetic valve.

According to the invention, it is possible to prevent back flow during no-load running and stoppage while contributing to a cost reduction.

Other objects, features and advantages of the invention will become apparent from the following description of the embodiments of the invention taken with the accompanying drawings.

BRIEF DESCRIPTION OF SEVERAL VIEWS OF DRAWINGS

DETAILED DESCRIPTION OF THE INVENTION

One embodiment according to the present invention will be described in detail below with reference to drawings.

Figure 1:
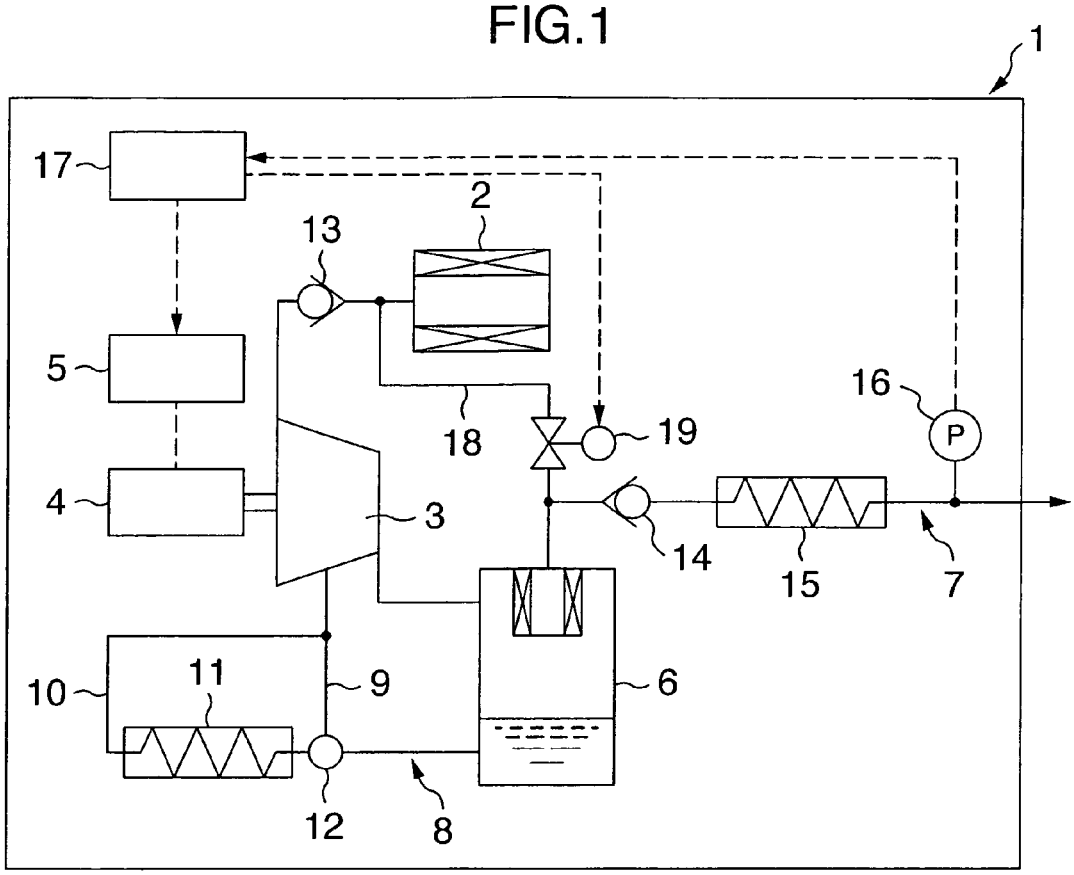
FIG. 1 is a schematic diagram showing an overall configuration of a screw compressor according to one embodiment of the invention.
Figure 2:
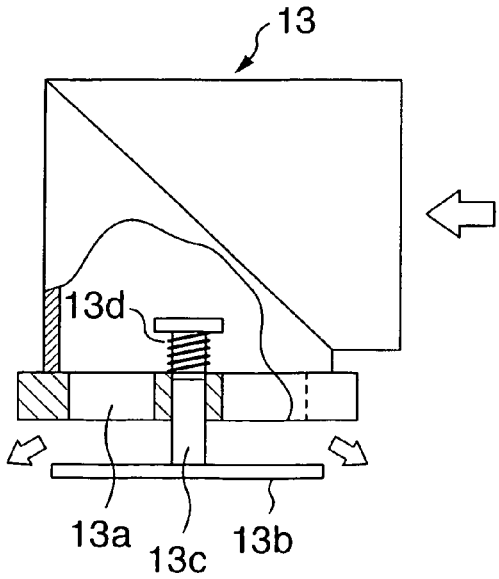
FIG. 2 is a section view showing a detailed structure of a suction non-return valve which constitutes the embodiment according to the invention.

FIG. 1 is a schematic diagram showing an overall configuration of a screw compressor according to the invention and FIG. 2, a sectional view showing a detailed structure of a suction non-return valve.

Referring to FIG. 1, an oil-injection screw compressor 1 is equipped with a compressor body 3 for compressing air sucked via a suction filter 2, a motor 4 for driving this compressor body 3, an inverter 5 for variably controlling the number of revolutions of this motor 4, an oil separator 6 for separating lubricating oil contained in compressed air generated by the compressor body 3 (details to be described afterwards), a compressed air supply line 7 for supplying the compressed air cleared of lubricating oil by this oil separator 6 to its destination, and a lubricating oil supply line 8 for supplying the lubricating oil separated by the oil separator 6 to the compressor body 3.

The lubricating oil supply line 8 is provided with supply piping 9 for supplying the lubricating oil separated by the oil separator 6 to the compressor body 3, bypass piping 10 disposed to bypass this supply piping 9, a heat exchanger 11 disposed on this bypass piping 10 to cool the lubricating oil, and a regulating valve 12 disposed at the upstream side branching point between the supply piping 9 and the bypass piping 10. By regulating the flow volume ratio of the lubricating oil in the supply piping 9 and the bypass piping 10 with this regulating valve 12, the temperature of the lubricating oil supplied to the compressor body 3 is controlled. The lubricating oil, introduced into the compression chamber of the compressor body 3, cools the compressed air and at the same time contributes to enhancing the efficiency of compression by reducing air leaks from the compression chamber. The lubricating oil is also introduced into the bearings of the compressor body 3 and elsewhere to lubricate these items.

On the suction side of the compressor body 3, there is provided a suction non-return valve 13 which is opened when the compressor body 3 is running and is closed when it is at a stop. The suction non-return valve 13 is provided with, for instance, as shown in FIG. 2, a valve plate 13*b* which can be in contact with an opening 13*a* to close the opening 13*a*, a shaft section 13*c* which, connected to the valve plate 13*b*, slides in the opening and closing directions of the valve plate 13*b*, and a spring 13*d* which gives a pressing force in the closing direction of the valve plate 13*b* (upward in FIG. 2) against a differential pressure (pressure downward in FIG. 2) that arises when the compressor body 3 is running. This pressing force of the spring 13*d* is set to be smaller than the sum of the differential pressure that arises when the compressor body 3 is running and the tares of the valve plate 13*b*, the shaft section 13*c* and so forth and greater than the tares of the valve plate 13*b*, the shaft section 13*c* and so forth, so as to make the valve plate 13*b* move in the opening direction of the valve plate 13*b* when the compressor body 3 is running, thereby to open the opening 13*a*, and so as to make the valve plate 13*b* move in the closing direction of the valve plate 13*b* when the compressor body 3 is at a stop, thereby to close the opening 13*a*. As a result, when the compressor body 3 is at a stop, compressed air containing lubricating oil can be prevented from flowing back.

The compressed air supply line 7 is equipped with a non-return valve 14 and a heat exchanger 15 for cooling compressed air. A pressure sensor 16 as a pressure detecting device is disposed on the outlet side of the heat exchanger 15, and the detection signal from this pressure sensor 16 is outputted to a controller 17. There is also provided blow-off piping 18 connecting the upper stream side of the non-return valve 14 and that of the suction non-return valve 13, and this blow-off piping 18 is equipped with a blow-off valve 19 which is driven for opening or closing in accordance with a control signal from the controller 17. The blow-off piping 18 and the blow-off valve 19 are so structured as to permit releasing of air beyond the quantity of discharged air from the compressor body 3 when the motor 4 is running at the minimum number of revolutions as will be described afterwards (for instance structured to have a large opening). In this embodiment, the blow-off valve 19 will be described as an electromagnetic valve which is driven for opening or closing in accordance with the control signal from the controller 17, but instead a pressure regulating valve (not shown) driven in accordance with a control signal from the controller 17 for instance may be added, and the driving for opening or closing may be accomplished with an air pressure, oil pressure or the like generated by the driving of this pressure regulating valve.

The controller 17 controls, as its first control function, the number N of revolutions of the motor 4 via the inverter 5 in accordance with a detection signal inputted from the pressure sensor 16. More specifically, when for instance the consumed quantity Q of air at the destination increases and the discharge side pressure P of the compressor body 3 drops, the number N of revolutions of the motor 4 is raised to increase the quantity of air discharged from the compressor body 3. Or when the consumed quantity Q of air at the destination decreases to raise the discharge side pressure P of the compressor body 3, the number N of revolutions of the motor 4 is lowered to decrease the quantity of air discharged from the compressor body 3. It is so disposed as to keep the discharge side pressure P of the compressor body 3 at a prescribed control pressure Po in the prescribed range of the consumed quantity Q of air (for instance 100% to 30% of the rated discharge capacity of the compressor body 3).

As its second function, the controller 17 controls the number N of revolutions of the motor 4 to its minimum, opens the blow-off valve 19 to bring down the discharge side pressure of the compressor body 3 to the atmospheric level and thereby causes the compressor body 3 to run under no load. Thus, when the consumed quantity Q of air at the destination is smaller than the discharge capacity of the compressor body 3 when the motor 4 is running at its minimum number of revolutions (for instance at or below 30% of the rated discharge capacity of the compressor body 3), if the motor 4 is running at the minimum of its number N of revolutions, the discharge side pressure P of the compressor body 3 cannot remain at the prescribed control pressure Po but rises. In such a case, the controller 17 judges whether or not the discharge side pressure P of the compressor body 3 has reached its prescribed upper limit Pu (where Pu>Po) and, if it has reached the prescribed upper limit Pu, the controller will open the blow-off valve 19 to bring down the pressure to the atmospheric level, and causes the compressor body 3 to run under no load. Or when the compressor body 3 is running under no load, as the discharge side pressure P of the compressor body 3 drops, the controller judges whether or not the pressure has fallen to the prescribed control pressure Po and, if it has reached the prescribed control pressure Po, will close the blow-off valve 19 to cause the compressor body 3 to return to loaded running. In this way, when the consumed quantity Q of air at the destination is small, loaded running and no-load running of the compressor body 3 will be repeated.

Also the controller 17 stops, as its third function, the motor 4 via the inverter 5 and thereby stops the compressor body 3 when the consumed quantity Q of air at the destination is very small (for instance only about 5% or less of the rated discharge capacity of the compressor body 3). More specifically, the loaded running duration of the compressor body 3 (in other words the pressure rise time taken by the discharge side pressure P of the compressor body 3 to rise from the prescribed control pressure Po to the prescribed upper limit Pu) and the no-load running duration (in other words the pressure fall time taken by the discharge side pressure P of the compressor body 3 to fall from the prescribed upper limit Pu to the prescribed control pressure Po) when the motor 4 is running at the minimum number of its number of revolutions are computed with a timer or the like, and it is judged whether or not the ratio between the loaded running duration and the non-load loaded running duration when the motor 4 is running at the minimum number of its number of revolutions as an indicator of the consumed quantity Q of air has reached a prescribed ratio (a preset and stored value or a value set by inputting with an input device) and, if the prescribed ratio has been reached, the motor 4 will be stopped and the compressor body 3 stopped. Or when the compressor body 3 is at a stop, it is judged whether or not the discharge side pressure P of the compressor body 3 has reached a prescribed restart pressure Ps and, if the prescribed restart pressure Ps has been reached, the motor 4 will be driven to restart the compressor body 3.

Figure 3:
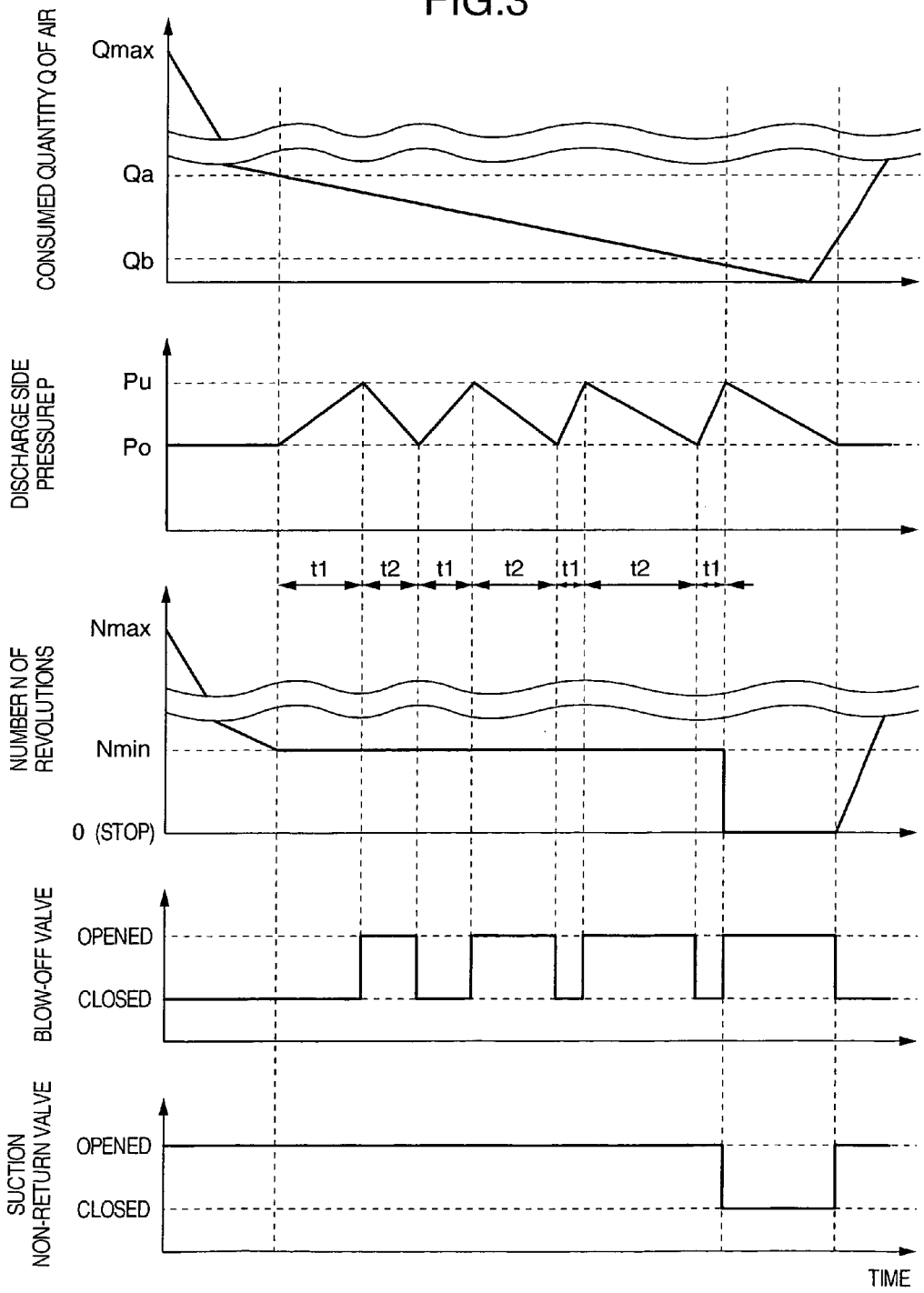
FIG. 3 is a time chart for describing an operation of the screw compressor according to the embodiment of the invention.

Next, an example of operation of the screw compressor 1 in this embodiment will be described. FIG. 3 is a time chart showing variations over time of the consumed quantity Q of air, the discharge side pressure P of the compressor body 3, the number N of revolutions of the motor 4, the blow-off valve 19 and the suction non-return valve 13 in the operating state.

Referring to FIG. 3, for instance when the consumed quantity Q of air decreases from the maximum consumed quantity Qmax of air (e.g. 100% of the rated quantity of air discharged of the compressor body 3) to an air quantity Qa (e.g. 30% of the rated quantity of air discharged of the compressor body 3), in order to keep the discharge side pressure P of the compressor body 3 at the prescribed control pressure Po, the number N of revolutions of the motor 4 is reduced from the maximum number Nmax of revolutions to the minimum number Nmin of revolutions (e.g. about 30% of the number Nmax of revolutions). When the consumed quantity Q of air further decreases beyond the air quantity Qa, as operation is carried on with the number N of revolutions of the motor 4 at its minimum Nmin, the discharge side pressure P of the compressor body 3 rises. And when the discharge side pressure P of the compressor body 3 reaches the prescribed upper limit Pu, the blow-off valve 19 is opened with the number N of revolutions of the motor 4 kept at its minimum Nmin, and the compressor body 3 is run under no load. After that, when the discharge side pressure P of the compressor body 3 drops and reaches the control pressure Po, the blow-off valve 19 is closed with the number N of revolutions of the motor 4 kept at its minimum Nmin, and the compressor body 3 is returned to loaded running. In this way, alternation of loaded running and no-load running of the compressor body 3 is repeated.

In this process, the controller 17 computes respectively loaded running time t1 and the no-load running time t2 of the compressor body 3 when the motor 4 is run at its minimum number Nmin of revolutions, and judges whether or not the ratio between the loaded running time t1 and the no-load running time t2 has reached a prescribed set ratio. If the consumed quantity Q of air decreases to around an air quantity Qb (e.g. 5% of the rated quantity of air discharged from the compressor body 3), the loaded running time t1 will become shorter while the no-load running time t2 becomes longer, the proportion of the loaded running t1/(t1+t2) becomes smaller (or the proportion of the no-load running t2/(t1+t2) becomes greater) to achieve the prescribed set ratio, the motor 4 will be stopped, and the compressor body 3 is stopped. Incidentally in this embodiment, when the discharge side pressure P of the compressor body 3 has reached Pu, the blow-off valve 19 is opened and the compressor body 3 is stopped. Then, the suction non-return valve 13 is closed by the pressing force of the spring 13*d* to enable the compressed air containing lubricating oil to be prevented from flowing back. And when the compressor body 3 is at a stop, if the discharge side pressure P of the compressor body 3 falls and reaches the prescribed restart pressure Ps (Ps=Po in this embodiment), the blow-off valve 19 will be closed to restart the compressor body 3.

In this embodiment described above, since the suction non-return valve 13 is so simply structured as to be closed by the pressing force of the spring 13*d*, the useful lives of components can be made longer and the cost lower than conventional suction throttle valves. Therefore, in this embodiment, back flow during the no-load running and stoppage of the compressor body 3 can be prevented while contributing to a cost reduction. Further, in this embodiment, in the region of operation where the consumed quantity Q of air is very small, when the discharge side pressure P of the compressor body 3 has reached its prescribed upper limit Pu, the compressor body 3 is stopped and, when the prescribed control pressure Po is reached while the compressor body 3 is at a stop, it is restarted. In this way, the power required in the region of operation where the consumed quantity Q of air is very small can be reduced.

Incidentally, though the foregoing description referred to a case in which the controller 17 has a control function to stop the compressor body 3 when the ratio between the loaded running time t1 and the no-load running time t2 when the motor 4 is running at its minimum number Nmin of revolutions has reached the prescribed set ratio, this is not the only possible arrangement. Thus, it may as well have a control function to stop the compressor body 3 when the loaded running time t1 or the no-load time t2 has reached a prescribed set length of time. In this case, the same effects as the foregoing can be achieved.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An oil-injection screw compressor in which oil is mixed into compressed gas, the oil-injection screw compressor comprising:

a compressor body for compressing sucked air;

a motor for driving said compressor body;

an inverter for variably controlling a number of revolutions of said motor;

a blow-off valve disposed on a discharge side of said compressor body and capable of releasing a quantity of air beyond the discharge capacity of said compressor body when operating said motor at a minimum number of revolutions;

a suction non-return valve which, disposed on a suction side of said compressor body, is configured to be opened when said compressor body is operating under load and under no load, and closed when it is at a stop; and a pressure detecting device for detecting a discharge side pressure of said compressor body, wherein it is controlled that, at the time of operation of said motor at the minimum number of revolutions, said compressor is run under no load to open said blow-off valve in a condition of the operation of said motor at the minimum number of revolutions when the discharge side pressure of said compressor body detected by said pressure detecting device has risen to a prescribed upper limit, and said compressor is run under load by closing said blow-off valve when it has fallen to a prescribed control pressure during the no-load running, and wherein it is controlled that, when said motor is stopped after the operation of said motor at the minimum number of revolutions, said blow-off valve is opened and said suction non-return valve is closed.

2. The oil-injection screw compressor as claimed in claim 1, further comprising:

a first stop control device which computes, using the discharge side pressure detected by said pressure detecting device, a pressure rise time, the pressure rise time being the time taken by the discharge side pressure to rise from said prescribed control pressure to said prescribed upper limit, and a pressure fall time, the pressure fall time being the time taken for the discharge side pressure to fall from said prescribed upper limit to said prescribed control pressure, during the operation of said motor at the minimum number of revolutions, and stops said compressor body when the ratio between these pressure rise time and pressure fall time has reached a prescribed set ratio.

3. The oil-injection screw compressor as claimed in claim 2, further comprising:

a restart control device which, while said compressor body is at a stop, restarts said compressor body when the discharge side pressure detected by said pressure detecting device has reached a prescribed restart pressure.

4. The oil-injection screw compressor as claimed in claim 1, further comprising:

a second stop control device which computes, using the discharge side pressure detected by said pressure detecting device, a pressure rise time, the pressure rise time being the time taken by the discharge side pressure to rise from said prescribed control pressure to said prescribed upper limit, and a pressure fall time, the pressure fall time being the time taken for the discharge side pressure to fall from said prescribed upper limit to said prescribed control pressure, during the operation of said motor at the minimum number of revolutions, and stops said compressor body when this pressure rise time or pressure fall time has reached a prescribed set time length.

5. The oil-injection screw compressor as claimed in claim 4, further comprising:

a restart control device which, while said compressor body is at a stop, restarts said compressor body when the discharge side pressure detected by said pressure detecting device has reached a prescribed restart pressure.

6. The oil-injection screw compressor as claimed in claim 1, wherein said blow-off valve is an electromagnetic valve.

7. The oil-injection screw compressor as claimed in claim 1, further comprising a controller configured to control operation of said motor and opening and closing of said blow-off valve.

8. An oil-injection screw compressor in which oil is mixed into compressed gas, the oil-injection screw compressor comprising:

a compressor body for compressing sucked air;

a motor for driving said compressor body;

an inverter for variably controlling the number of revolutions of said motor;

a suction non-return valve which, disposed on a suction side of said compressor body, is configured to be opened when said compressor body is operating under load and under no load, and closed when it is at a stop;

an oil separator for separating lubricating oil contained in the compressed gas generated by said compressor body;

a compressed air supply line for supplying the compressed air cleared of the lubricating oil by said oil separator;

blow-off piping connecting an upper stream side of said suction non-return valve and said compressed air supply line;

a blow-off valve provided on said blow-off piping and capable of releasing a quantity of air beyond the discharge capacity of said compressor body when operating said motor at a minimum number of revolutions; and a pressure detecting device for detecting a discharge side pressure of said compressor body wherein it is controlled that, at the time of operation of said motor at the minimum number of revolutions, said compressor is run under no load to open said blow-off valve in a condition of the operation of said motor at the minimum number of revolutions when the discharge side pressure of said compressor body detected by said pressure detecting device has risen to a prescribed upper limit, and said compressor is run under load by closing said blow-off valve when it has fallen to a prescribed control pressure during the no-load running, and wherein it is controlled that, when said motor is stopped after the operation of said motor at the minimum number of revolutions, said blow-off valve is opened and said suction non-return valve is closed.

9. The oil-injection screw compressor as claimed in claim 8, further comprising:

a first stop control device which computes, using the discharge side pressure detected by said pressure detecting device, a pressure rise time, the pressure rise time being the time taken by the discharge side pressure to rise from said prescribed control pressure to said prescribed upper limit, and a pressure fall time, the pressure fall time being the time taken for the discharge side pressure to fall from said prescribed upper limit to said prescribed control pressure, during the operation of said motor at the minimum number of revolutions, and stops said compressor body when the ratio between these pressure rise time and pressure fall time has reached a prescribed set ratio.

10. The oil-injection screw compressor as claimed in claim 9, further comprising:

a restart control device which, while said compressor body is at a stop, restarts said compressor body when the discharge side pressure detected by said pressure detecting device has reached a prescribed restart pressure.

11. The oil-injection screw compressor as claimed in claim 8, further comprising:

a second stop control device which computes, using the discharge side pressure detected by said pressure detecting device, a pressure rise time, the pressure rise time being the time taken by the discharge side pressure to rise from said prescribed control pressure to said prescribed upper limit, and a pressure fall time, the pressure fall time being the time taken for the discharge side pressure to fall from said prescribed upper limit to said prescribed control pressure, during the operation of said motor at the minimum number of revolutions, and stops said compressor body when this pressure rise time or pressure fall time has reached a prescribed set time length.

12. The oil-injection screw compressor as claimed in claim 11, further comprising:

a restart control device which, while said compressor body is at a stop, restarts said compressor body when the discharge side pressure detected by said pressure detecting device has reached a prescribed restart pressure.

13. The oil-injection screw compressor as claimed in claim 8, wherein said blow-off valve is an electromagnetic valve.

14. The oil-injection screw compressor as claimed in claim 8, further comprising a controller configured to control operation of said motor and opening and closing of said blow-off valve.

* * * * *